US009534809B2

(12) United States Patent
Faldetta

(10) Patent No.: US 9,534,809 B2
(45) Date of Patent: Jan. 3, 2017

(54) ICE CORRALLING DEVICE

(71) Applicant: John Faldetta, New York, NY (US)

(72) Inventor: John Faldetta, New York, NY (US)

( * ) Notice: Subject to any disclaimer, the term of this patent is extended or adjusted under 35 U.S.C. 154(b) by 0 days.

(21) Appl. No.: 14/708,813

(22) Filed: May 11, 2015

(65) Prior Publication Data

US 2016/0334130 A1 Nov. 17, 2016

(51) Int. Cl.
*F24F 13/22* (2006.01)

(52) U.S. Cl.
CPC ..... *F24F 13/224* (2013.01)

(58) Field of Classification Search
CPC ..... F24F 13/224; E06B 3/12; E06B 3/5821; E06B 7/14
USPC ..... 52/24–26, 716.1, 716.4, 716.6, 716.8,52/718.01, 718.04, 718.05, 718.02
See application file for complete search history.

(56) References Cited

U.S. PATENT DOCUMENTS 3,942,290 A 3/1976 O'Sheeran
4,434,594 A * 3/1984 Bliss ..... E06B 3/12 52/209
4,894,963 A * 1/1990 Campbell ..... E04B 1/26 52/105
5,365,992 A * 11/1994 Swain ..... F24F 13/32 160/84.01
2011/0073746 A1 3/2011 Padiotis

FOREIGN PATENT DOCUMENTS

JP 08-327096 A 12/1996
JP 11-173606 A 7/1999
KR 10-2014-0045465 A 4/2014

OTHER PUBLICATIONS

International Search Report and Written Opinion dated Aug. 16, 2016, in connection with corresponding International (PCT) Application No. PCT/US2016/031583 (12 pgs.).

* cited by examiner

*Primary Examiner* — Jeanette E Chapman
(74) *Attorney, Agent, or Firm* — Maier & Maier, PLLC

(57) ABSTRACT

An ice corralling apparatus may be provided. An ice corralling apparatus may include at least one member having a vertical portion and a securing flange. The securing flange may secure the vertical portion to a top perimeter of a window unit air conditioner, such that a top of the vertical portion projects upward from the perimeter, forming a retaining barrier.

7 Claims, 3 Drawing Sheets

ICE CORRALLING DEVICE

BACKGROUND

Window air conditioning units are utilized in buildings and structures lacking central air conditioning. Window units generally engage and extend outward in a pitched fashion from an open window frame. Window A/C units may be temporarily or permanently secured to a window frame. Even temporarily installed window units may be left in a window year round, due to the difficult and possibly dangerous nature of removing and installing window units. A typical window unit has a top surface area sufficient to catch and retain precipitation, such as snow or sleet. A combination of sun warmth and warm air escaping a structure through the window unit may cause snow or layers of snow to melt and subsequently form ice when conditions allow. Snow or ice can cause a dangerous situation by falling from window units. Wind, gravity, or other forces may cause snow or ice to fall from window units. It therefore may be desirable to have additional precipitation retaining and dissipating devices on window units.

SUMMARY

According to an exemplary embodiment, an ice corralling apparatus may be disclosed. An ice corralling apparatus may include at least one member. The at least one member may have a vertical portion, which may include a plurality of weeps. The weeps may be disposed above and below a middle of the vertical portion. The at least one member may further include a securing flange projecting from an inner surface proximate the middle of the vertical portion.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Figure 1:
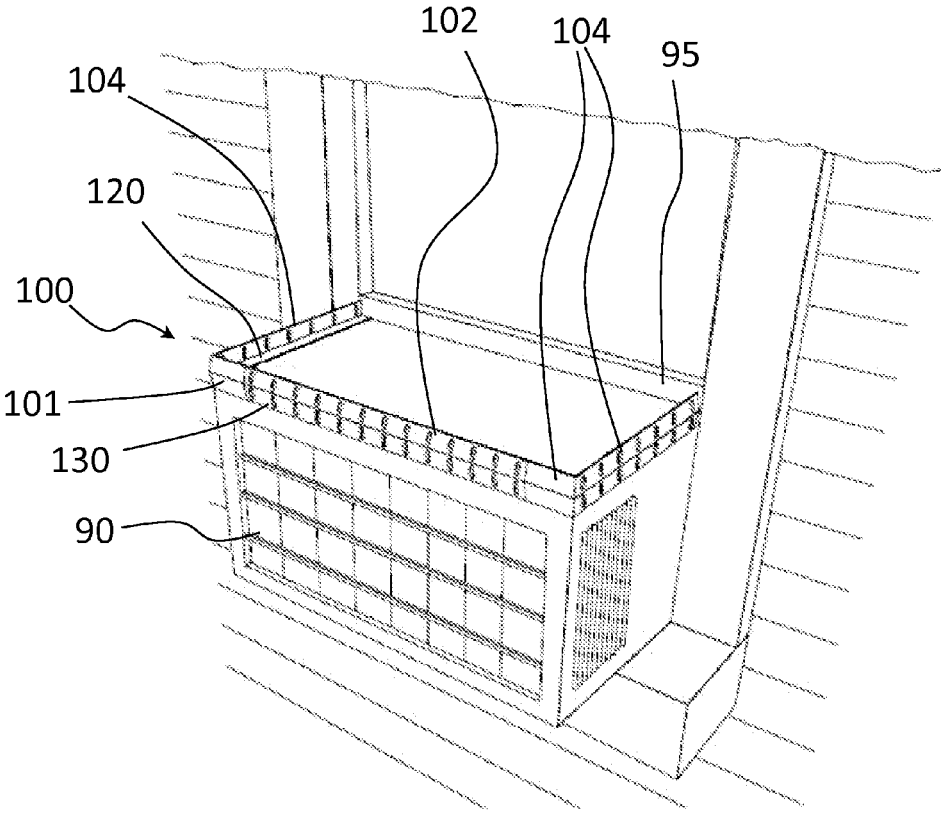
FIG. 1 shows a perspective view of an ice corralling apparatus with environment.
Figure 2:
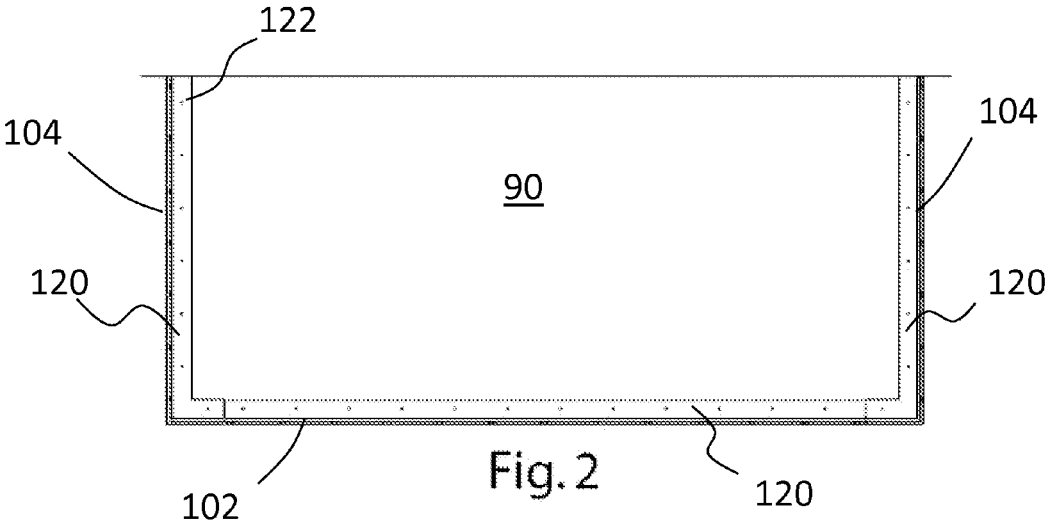
FIG. 2 shows a top plan view of an ice corralling apparatus with environment.
Figure 3:
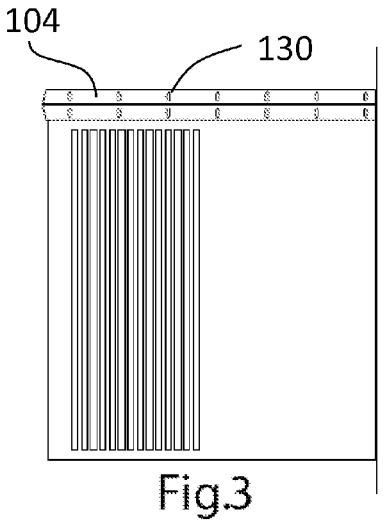
FIG. 3 shows a right side elevation view of an ice corralling apparatus with environment.
Figure 4:
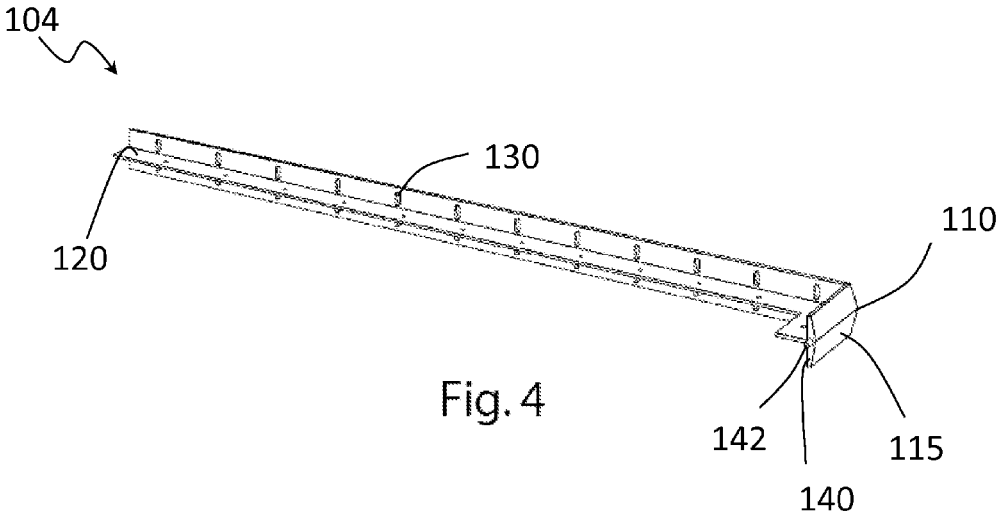
FIG. 4 shows a perspective view of a side member of an ice corralling apparatus.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments" or "invention" do not require that all embodiments of the invention include the discussed feature, advantage or mode of operation.

Referring to the figures generally, an ice corralling apparatus 100 may be provided. An ice corralling apparatus 100 may prevent built up snow and ice from falling on passersby from window unit air conditioners. In an exemplary embodiment, an ice corralling apparatus 100 may include a vertical portion 101 and a horizontal securing flange 120 that may result in an upwardly projecting retaining member when secured to a top perimeter of a window unit air conditioner 90.

According to an exemplary embodiment, an ice corralling apparatus 100 may include a single member, or multiple members capable of being pieced together. The at least one member may match the portion of the top perimeter of a window unit air conditioner 90 that protrudes from a window frame 95 or window opening. It may be understood by a person having ordinary skill in the art that an ice corralling apparatus 100 may include any desired number of members so long as the functionality described herein is maintained. In some embodiments, there may be gaps between members. The gaps may act as weeps and may be sized so as not to allow dangerous amounts of snow or ice to pass through.

In at least one exemplary embodiment of an ice corralling apparatus 100, there may be a central member 102 and two side members 104. Each member 102/104 may have a vertical portion 101 having a substantially flat inner surface 106. An outer surface 108 of the vertical portion 101 may be substantially tapered from the middle 110 to a top edge 112 and bottom edge 114, such that the middle 110 is the thickest portion of the vertical portion 101. The taper of the vertical portion 101 may strengthen the members 102/104 to resist outward pressure from retained ice or snow. Side members 104 in an exemplary embodiment may include corner portions, which may correlate to corners on the perimeter of the top surface of a window unit air conditioner 90. In such embodiments, a central member 102 may be sized to accommodate the length of side members extending past a corner. In alternative exemplary embodiments, a central member 102 and side members 104 may each coordinate with the length of a side of a window unit air conditioner 90 and may subsequently form corner portions where they join. Members may further be cut to adjust the size or create additional members.

Figure 7:
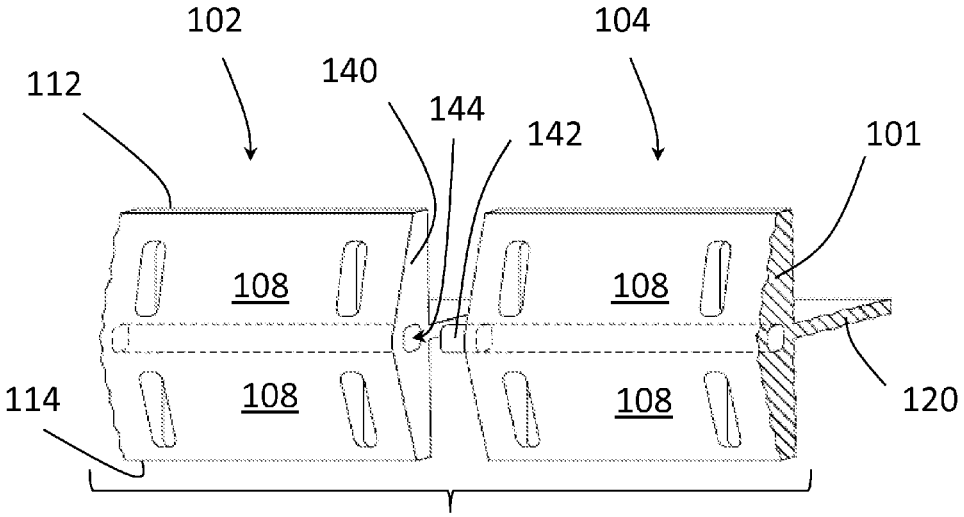
FIG. 7 shows an exploded view of connection of members of an ice corralling apparatus.

Each member 102/104 of an ice corralling apparatus 100 may be capable of connecting to an adjacent member. In an exemplary embodiment, the end faces 140 of each member 102/104 may include a connector for connecting to a corresponding face of an adjacent member 102/104. Connectors may include male connectors 142 and female connectors 144. Male connectors 142 may be substantially peg-like and female connectors 144 may be corresponding holes. The male and female connectors may be sized to create a secure connection between members 102/104. In some embodiments, additional fasteners may be applied to secure the connection, such as adhesive. In one exemplary embodiment, a central member may have a female connector 144 disposed in each end face 140. Female connectors 144 may alternatively be a single hole disposed through the length of the member. Side members 104 may have a male connector 142 on the end face that may be adjacent to an end face 140 of central member 102. In some embodiments, side members may have no connector or may have a female connector 144 on the end face adjacent the window frame 95. As previously discussed, the female connector 144 may be disposed in the end face 140 and in some embodiments may be disposed through the length of the member 102/104, as shown in exemplary FIG. 7. In embodiments where a female connector 144, or hole, is disposed through the length of the member 102/104, a male connector 142 may be affixed to an end face 140 over the female connector 144 where needed or may be an independent peg inserted in a female connector 144 disposed on each end face 140 of adjacent members 102/104.

Figure 5:
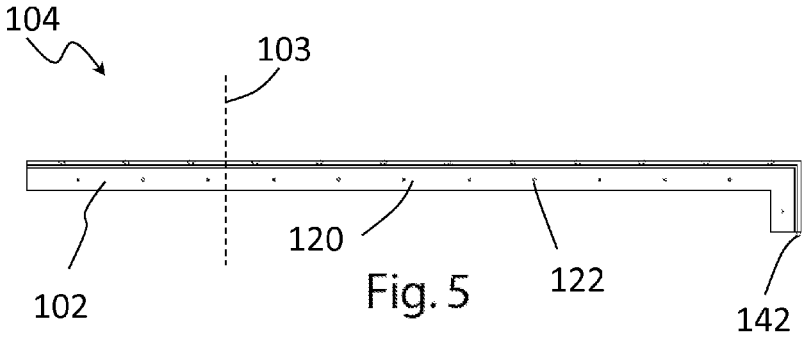
FIG. 5 shows a top plan view of a side member of an ice corralling apparatus.
Figure 6:
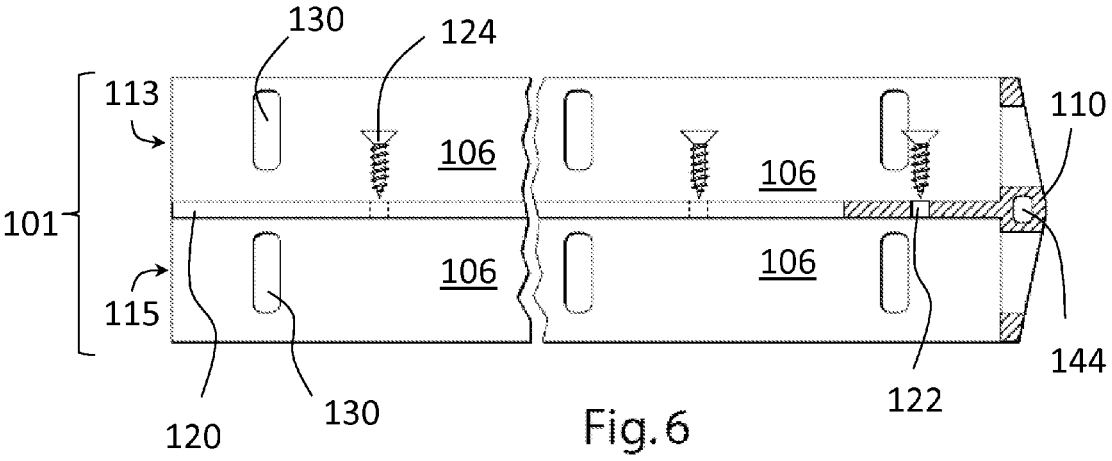
FIG. 6 shows an elevation view of a member of an ice corralling apparatus.

In an exemplary embodiment having a female connector 144, or hole, disposed through the length of the members 102/104, a central member 102 may be cut from a side member 104. This may allow an ice corralling apparatus to be sold as just two side members 104. Side members 104 may be of a length sufficiently longer than the perimeter of a target window unit air conditioner that a central member 102 can be cut from the excess length of a side member 104. For example, as shown in exemplary FIG. 5, a side member 104 may be cut along a cutline 103 resulting in a central member 102. The location of cutline 103 may vary, as desired. The location may further be based on the size of a target window unit air conditioner. Each side members 104 may optionally be of sufficient length to cut a central member 102. Alternatively, a single side member 104 may be of sufficient length to cut a central member 102.

Each member may have a securing flange 120 projecting from an inner surface 106 thereof. In an exemplary embodiment, the securing flange 120 may be formed integrally with each member 102/104. In alternative exemplary embodiments, the securing flange may be attached to members 102/104 by adhesive, welding, securing joints, screws, bolts, or other fasteners, as would be understood by a person having ordinary skill in the art. Securing flange 120 may be substantially perpendicular to the inner surface 106 of the members 102/104 and may project from the inner surface 106 proximate a middle 110 of the vertical portion 101. The securing flange 120 and the inner surface 106 of a bottom portion 115 of members 102/104 may form an angle, which may fit over a perimeter edge of a window unit air conditioner 90. This may support an ice corralling apparatus 100 on a window unit air conditioner 90 such that an upper portion 113 of the members 102/104 may project vertically above the top perimeter of the window unit air conditioner 90, so as to form a retaining barrier. In an exemplary embodiment, the securing flange 120 may be capable of being secured to the surface of a window unit air conditioner 90. The securing flange 120 may be secured by adhesive, welding, screws, bolts, nuts, clamps, straps, hook and loop type fasteners, nails, staples, and other fasteners, as would be understood by a person having ordinary skill in the art. In an exemplary embodiment, securing flange 120 may include fastener holes 122, which may pass through securing flange 120 at predetermined locations. Fasteners, such as screws may pass through fastener holes 122 and into a top surface of a window unit air conditioner 90 or an intermediate surface, which may be used for securing an ice corralling apparatus 100 without damaging components of a window unit air conditioner 90. In an exemplary embodiment, the predetermined locations of fastener holes 122 and the size and type of fasteners may be selected such that fasteners 124 may pass into a window unit air conditioner 90 without affecting its functionality. For example, fastener holes 122 may be located within a certain distance of vertical portion 101, so as to ensure they are proximate an outer perimeter of the window unit air conditioner 90. In an exemplary embodiment, fastener holes 122 may be within approximately one inch of the inner surface 106 of vertical portion 101. In yet other embodiments, fastener holes 122 may be located to correspond with fastener counterparts in the surface of a window unit air conditioner 90. Fastener holes 122 may further be located to maintain the integrity of the securing flange 120 and members 102/104 when fasteners 124 are tightened in the fastener holes 122.

Members 102/104 may further include a plurality of weeps 130, or holes, which may allow for drainage of melted snow and ice. The number and spacing of weeps 130 may vary as desired. In some exemplary embodiments, weeps 130 may be disposed at intervals of approximately one inch to approximately three inches. Members 102/104 may be vertically symmetrical about the plane of the securing flange 120, including weeps 130. This may allow side members 104 to be interchangeable. Weeps 130 may allow melted snow or ice to dissipate in safe, small quantities.

In an exemplary embodiment, an ice corralling apparatus 100 may be made of plastic. In such embodiments, members of an ice corralling apparatus 100 may be formed in a variety of ways, such as, but not limited to injection molding. However, it may be understood by a person having ordinary skill in the art that a variety of materials may be used to accomplish the same functionality, such as wood, rubber, metals, ceramics, and polymers.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An ice corralling apparatus comprising:

at least one member, the at least one member comprising a vertical portion having a plurality of weeps disposed above and below a middle thereof, and a securing flange projecting from an inner surface proximate the middle of the vertical portion, wherein the vertical portion of the at least one member is tapered from the middle to a top edge and bottom edge, such that the middle is the thickest part of the vertical portion, and wherein the securing flange is substantially perpendicular to the inner surface of the vertical portion and each member is vertically symmetrical about the plane of the securing flange.

2. The ice corralling apparatus of claim 1, further comprising a central member and two side members, each side member configured to extend from a window opening along a top perimeter of a window unit air conditioner and connect to a central member along a front perimeter of the window unit air conditioner.

3. The ice corralling apparatus of claim 2, wherein the central member comprises a female connector on both end faces and wherein the side members comprise a male connector on each end face configured to connect to the end faces of the central member.

4. The ice corralling apparatus of claim 2, wherein each side member extends around a corner of the top perimeter and the central member extends along a portion of the front side of the top perimeter.

5. The ice corralling apparatus of claim 2, wherein the central member is cut from the end of a side member.

6. The ice corralling apparatus of claim 1, further comprising a plurality of fastener holes disposed in the securing flange.

7. The ice corralling apparatus of claim 1, further comprising at least one of a male or female connector disposed in end surfaces of the at least one member.

* * * * *